US008773223B2

(12) United States Patent
Kawai et al.

(10) Patent No.: US 8,773,223 B2
(45) **Date of Patent: *Jul. 8, 2014**

(54) VARIABLE RESONATOR AND VARIABLE FILTER

(75) Inventors: Kunihiro Kawai, Yokohama (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 617 days.

This patent is subject to a terminal disclaimer.

(21) Appl. No.: 12/944,975

(22) Filed: Nov. 12, 2010

(65) Prior Publication Data

US 2011/0115574 A1 May 19, 2011

(30) Foreign Application Priority Data

Nov. 17, 2009 (JP) ..... 2009-261838

(51) Int. Cl.
*H01P 1/203* (2006.01)
*H01P 7/08* (2006.01)

(52) U.S. Cl.
CPC ..... *H01P 1/20381* (2013.01); *H01P 7/088* (2013.01)
USPC ..... 333/205; 333/235

(58) Field of Classification Search
CPC ..... H01P 1/20381; H01P 7/088
USPC ..... 333/204, 205, 219, 235
See application file for complete search history.

(56) References Cited

U.S. PATENT DOCUMENTS 5,162,759 A 11/1992 Yajima
6,326,865 B1 12/2001 Kundu et al.
7,135,940 B2 11/2006 Kawakubo et al.
7,292,124 B2 11/2007 Kawai et al.
7,583,168 B2 9/2009 Kawai et al.
8,106,727 B2 * 1/2012 Kawai et al. ..... 333/205
8,324,988 B2 * 12/2012 Kawai et al. ..... 333/205

(Continued)

FOREIGN PATENT DOCUMENTS

CN 101252217 A 8/2008
EP 1 962 367 A1 8/2008

(Continued)

OTHER PUBLICATIONS

Dimitrios Peroulis et al., "Tunable Lumped Components with Applications to Reconfigurable MEMS Filters", IEEE MTT-S Digests, 2001, 4 pages.

(Continued)

*Primary Examiner* — Benny Lee
*Assistant Examiner* — Gerald Stevens
(74) *Attorney, Agent, or Firm* — Oblon, Spivak, McClelland, Maier & Neustadt, L.L.P.

(57) ABSTRACT

A switch is replaced with a parallel resonant circuit 4. More specifically, a variable resonator includes a line part 1 that includes one or more lines and has an annular shape, at least two parallel resonant circuits 4 capable of changing a characteristic, and at least three variable reactance blocks 2 capable of changing a reactance value, in which the parallel resonant circuits 4 are electrically connected to the line part 1 at one end thereof at different positions on the line part 1, and the variable reactance blocks 2 are electrically connected to the line part 1 at predetermined intervals based on an electrical length at a resonance frequency.

9 Claims, 16 Drawing Sheets

(56) References Cited

U.S. PATENT DOCUMENTS

| | | | | |
|---|---|---|---|---|
| 8,330,562 | B2 * | 12/2012 | Kawai et al. | 333/205 |
| 2003/0025563 | A1 | 2/2003 | Christensen | |
| 2003/0034858 | A1 * | 2/2003 | Zhu | 333/164 |
| 2008/0204168 | A1 | 8/2008 | Kawai et al. | |
| 2013/0057363 | A1 * | 3/2013 | Kawai et al. | 333/205 |

FOREIGN PATENT DOCUMENTS

| | | |
|---|---|---|
| JP | 2001-230602 | 8/2001 |
| JP | 2004-7352 | 1/2004 |
| JP | 2005-217852 | 8/2005 |
| JP | 2005-295316 | 10/2005 |
| JP | 2007-166596 | 6/2007 |
| JP | 2008-206078 | 9/2008 |
| KR | 10-2008-0078566 | 8/2008 |

OTHER PUBLICATIONS

Hong-Teuk Kim et al., "Low-Loss and Compact V-Band MEMS-Based Analog Tunable Bandpass Filters", IEEE Microwave and Wireless Components Letters, vol. 12, No. 11, Nov. 2002, 3 pages.
E. Fourn et al., "Bandwidth and Central Frequency Control on Tunable Bandpass Filter by Using MEMS Cantilevers", IEEE MTT-S Digest, 2003, 4 pages.
Arnaud Pothier et al., "Low-Loss 2-Bit Tunable Bandpass Filters Using MEMS DC Contact Switches", IEEE Transactions on Microwave Theory and Techniques, vol. 53, No. 1, Jan. 2005, 7 pages.
Bruce E. Carey-Smith et al., "Wide Tuning-Range Planar Filters Using Lumped-Distributed Coupled Resonators", IEEE Transactions on Microwave Theory and Techniques, vol. 53. No. 2, Feb. 2005, 9 pages.
Kamran Entesari et al., "A Differential 4-bit 6.5-10-GHz RF MEMS Tunable Filter", IEEE Transactions on Microwave Theory and Techniques, vol. 53, No. 3, Mar. 2005, 8 pages.
Kamran Entesari et al. "A 12-18-GHz Three-Pole RF MEMS Tunable Filter", IEEE Transactions on Microwave Theory and Techniques, vol. 53, No. 8, Aug. 2005, 6 pages.
Lung-Hwa Hsieh et al., "Slow Wave Bandpass Filters Using Ring or Stepped-Impedance Hairpin Resonators", IEEE Transactions on Microwave Theory and Techniques, vol. 50, No. 7, Jul. 2002, 6 pages.
Kunihiro Kawai et al., "Tunable Resonator Employing Comb-Shaped Transmission Line and Switches", Proceedings of 35$^{th}$ European Microwave Conference, Oct. 2005, 4 pages.
Arun Chandra Kundu et al., "Attenuation Pole Frequency Control of a Dual-Mode Circular Microstrip Ring Resonator BPF", Proceedings of 29$^{th}$ European Microwave Conference, Oct. 1999, 4 pages.
Kunihiro Kawai et al., "Tunable Band-pass Filter Employing Comb-shaped Transmission Line Resonator", Electronics Society Conference of the Institute of Electronics, Information and Communication Engineers, C-2-37, 2005, 4 pages. (with English Translation).
Kunihiro Kawai et al., "Center-frequency and Bandwidth Tunable Band-pass Filter Employing Comb-shaped Transmission Line Resonator", General Conference of the Institute of Electronics, Information and Communication Engineers, C-2-35, 2006, 4 pages. (with English Translation).
Kunihiro Kawai et al., "Center Frequency and Bandwidth Tunable Filter Employing Tunable Comb-Shaped Transmission Line Resonators and J-inverters", Proceedings of 36$^{th}$ European Microwave Conference, Sep. 2006. 4 pages.
Kunihiro Kawai et al., "Comb-shaped Transmission Line Tunable Resonator Employing MEMS RF Switches", Electronics Society Conference of the Institute of Electronics, Information and Communication Engineers, C-2-77, 2006, 4 pages. (with English Translation).
Lei Zhu et al., "A Joint Field/Circuit Design Model of Microstrip Ring Dual-Mode Filter: Theory and Experiments", Proceedings of 1997 Asia Pacific Microwave Conference, 1997, 4 pages.
S.H. Al-Charchafchi et al., "Varactor tuned microstrip ring resonators", IEE Proceedings, vol. 136, Pt. H, No. 2, Apr. 1989, 4 pages.
T. Scott Martin et al., "Electronically Tunable and Switchable Filters Using Microstrip Ring Resonator Circuits", IEEE MTT-S Digest, 1988, 4 pages.
P. Gardner et al., "Microwave voltage tuned microstrip ring resonator oscillator", Electronics Letters, vol. 30, No. 21, Oct. 13, 1994, 2 pages.
Michiaki Matsuo et al., "Dual-Mode Stepped-Impedance Ring Resonator for Bandpass Filter Applications", IEEE Transactions on Microwave Theory and Techniques, vol. 49, No. 7, Jul. 2001, 6 pages.
Hitoshi Ishida et al., "A design of tunable UWB filters", IEEE International Workshop on Ultra Wideband Systems, May 2004, 5 pages.
Kouki Saitou et al., "Tunable Duplexer Having Multilayer Structure Using LTCC", IEEE MTT-S Digest, 2003, 4 pages.
F. A. Miranda et al., "A K-Band (HTS,Gold)/Ferroelectric Thin Film/Dielectric Diplexer for a Discriminator-Locked Tunable Oscillator", IEEE Transactions on Applied Superconductivity. vol. 9, No. 2, Jun. 1999, 4 pages.
Kunihiro Kawai at al., "Ring Resonators for Bandwidth and Center Frequency Tunable Filter", Proceedings of the 37$^{th}$ European Microwave Conference, Oct. 2007, 4 pages.
Kunihiro Kawai et al., "Tunable Ring Resonator Filter for Duplexer", Proceedings of the 38$^{th}$ European Microwave Conference, Oct. 2008, 4 pages.
Kunihiro Kawai et al., "Center Frequency, Bandwidth, and Transfer Function Tunable Bandpass Filter Using Ring Resonator and J-inverter", Proceedings of the 39$^{th}$ European Microwave Conference, Sep. 29-Oct. 1, 2009, 4 pages.
Extended European Search Report issued Mar. 22, 2011, in Patent Application No. 10190524.8.
Chinese Office Action issued Mar. 11, 2013, in China Patent Application No. 201010551081.6 (with English translation).
Office Action issued Jun. 14, 2012 in European Application No. 10 190 524.8.
Office Action issued Dec. 9, 2011 in Korea Application No. 10-2010-0110221 (With English Translation).
Office Action issued Dec. 20, 2011 in Japan Application No. 2009-261838 (With English Translation).
Second Office Action issued Oct. 10, 2013 in Chinese Patent Application No. 201010551081.6 with English Translation.

* cited by examiner

Cr=0pF, Con=1.8pF, Coff=0.7pF

Cr=0pF, Con=2.2pF, Coff=0.7pF

VARIABLE RESONATOR AND VARIABLE FILTER

TECHNICAL FIELD

The present invention relates to a variable resonator and a variable filter.

BACKGROUND ART

A variable resonator capable of independently changing the resonance frequency and the bandwidth of the resonance frequency is disclosed in Japanese Patent Application Laid-Open No. 2008-206078.

As shown in FIG. 18, the variable resonator comprises an annular line part 1, three or more variable reactance blocks 2 connected to the annular line part 1, and a plurality of switches 3 connected to the annular line part 1. The variable reactance blocks 2 are connected to the annular line part 1 at regular intervals along the circumference thereof, and the switches 3 are connected to the annular line part 1 at different positions.

The resonance frequency can be changed by changing the reactance value of the variable reactance blocks 2, and the bandwidth can be changed by changing the switch 3 to be turned on.

SUMMARY OF THE INVENTION

However, the variable resonator described in the Japanese Patent Application Laid-Open No. 2008-206078 requires a switch having high isolation characteristics as the switch 3 and thus is expensive to manufacture.

To solve the problem, the present invention uses a parallel resonant circuit instead of the switch.

Effects of the Invention

Replacing the switch with the parallel resonant circuit reduces the cost of manufacturing a variable resonator and a variable filter.

DETAILED DESCRIPTION OF THE EMBODIMENTS

Figure 1:
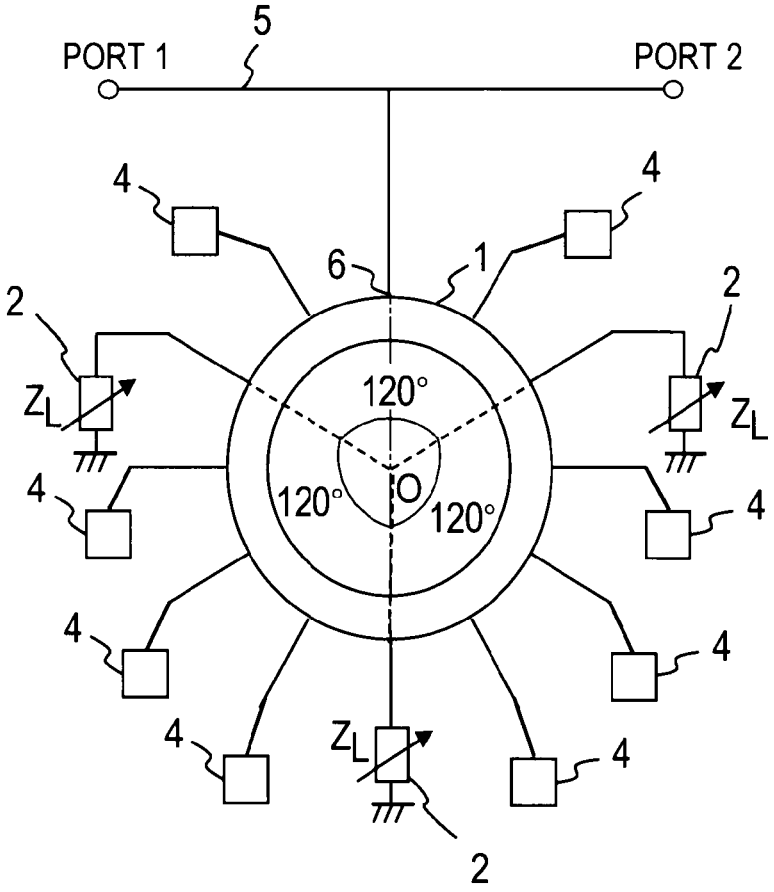
FIG. 1 is a diagram for illustrating a variable resonator according to the present invention.

FIG. 1 shows a variable resonator using a microstrip line according to an embodiment of the present invention.

The variable resonator comprises a closed annular line part 1, at least two parallel resonant circuits 4 having variable characteristics, and N variable reactance blocks 2 (N represents an integer equal to or greater than 3 ($N \geq 3$)).

The line part 1 is made of a conductor, such as metal, and formed on one surface of a dielectric substrate. A grounding conductor made of a conductor, such as metal, is formed on a surface of the dielectric substrate opposite to the surface on which the line part 1 is formed (referred to as a back surface).

The line part 1 is an annular line having a length that provides a phase shift of $2\pi$ or $360°$ at a desired resonance frequency, that is, a length equal to one wavelength or an integral multiple thereof at the resonance frequency. In FIG. 1, the variable resonator is shown as having a circular annular line for the sake of illustration. The term "annular" used herein means a simple closed curve. That is, the line part 1 is a line that has the starting point and the end point coinciding with each other and does not intersect with itself.

The term "length" means the perimeter of the annular line. More specifically, the term "length" means the distance from a point on the annular line to the same point along the circumference of the annular line.

The "desired resonance frequency" is one of typical performance requirements of the resonator and can be arbitrarily designed. The variable resonator can be used in an alternating-current circuit. Although there is no particular constraint on the resonance frequency of the variable resonator, the variable resonator is particularly useful when the resonance frequency is a high frequency of 100 kHz or higher, for example.

The line part 1 preferably has a uniform characteristic impedance. The expression "have an uniform characteristic impedance" means that when the annular line part 1 is cut with respect to a circumference direction so as to be fragmented into segments, these segments have severally the same characteristic impedance. However, a perfectly uniform characteristic impedance is not an essential technical factor, and the line part 1 only needs to have a substantially uniform characteristic impedance from a practical viewpoint. Assuming that the dimension of the line part 1 in the direction perpendicular to the circumference thereof is referred to as a width of the line part 1, the line part 1 has an uniform characteristic impedance when the line part 1 has substantially the same width at any point along the circumference, if the dielectric substrate has a uniform relative dielectric constant, for example.

An impedance Z is expressed by a formula: Z=R+jX (where j represents an imaginary unit). Ideally, for the impedance $Z_L$ of the variable reactance block 2, R is equal to zero (R=0), and X is variable. Although R is practically not equal to zero (R≠0), it has no effect on the basic principle of the present invention. Specific examples of the variable reactance block 2 include a circuit element, such as a variable capacitor, a variable inductor and a transmission line, a circuit formed by combining the same ones of the circuit elements described above, and a circuit formed by combining different ones of the circuit elements described above. As described later, the variable reactance block 2 may be the same circuit as the parallel resonant circuit 4.

The N variable reactance blocks 2 need to be able to have the same or substantially the same reactance value. The reason why the N variable reactance blocks 2 only need to have "substantially the same" reactance value, or in other words, why the N variable reactance blocks 2 are not strictly required to have exactly the same reactance value as a design requirement is that, although a slight difference in reactance value among the N variable reactance blocks 2 leads to a slight fluctuation of the resonance frequency (that is, the desired resonance frequency cannot be kept), such a slight fluctuation of the resonance frequency is accommodated in the bandwidth and thus poses no practical problem. In the following, it is assumed that a description of the N variable reactance blocks 2 as having the same reactance value can include this meaning.

The N variable reactance blocks 2 are electrically connected to the line part 1 as a branch circuit along the circumference thereof at equal electrical distances at a resonance frequency at which one wavelength or an integral multiple thereof equals to the perimeter of the line part 1. In a practical design, the resonance frequency at which one wavelength or an integral multiple thereof equals to the perimeter of the line part 1 can be the resonance frequency of the variable resonator having no variable reactance block 2 connected thereto, for example. If the dielectric substrate has a uniform relative dielectric constant, the equal electrical distances are equivalent to equal physical distances. In this case, if the line part 1 has a circular shape, the N variable reactance blocks 2 are connected to the line part 1 at intervals where each central angle formed by the center O of the line part 1 and connection points of any adjacent two of the N variable reactance blocks 2 is 360° divided by N (see FIG. 1).

In the example shown in FIG. 1, an end of each variable reactance block 2 opposite to the end connected to the line part 1 is grounded by electrical connection to a grounding conductor provided on the back surface of the dielectric substrate, for example. However, the variable reactance block 2 can be formed by a transmission line, for example, and therefore, the end of the variable reactance block 2 opposite to the end connected to the line part 1 does not always have to be grounded.

The resonance frequency can be changed by changing the reactance value of the variable reactance block 2. For details, see the Japanese Patent Application Laid-Open No. 2008-206078.

Figure 2:
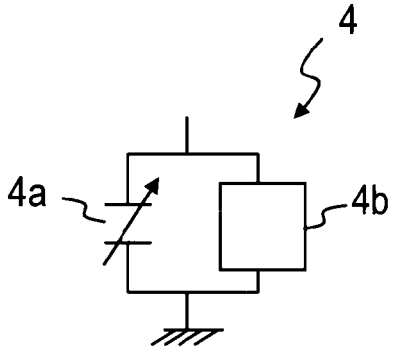
FIG. 2 is a diagram for illustrating a parallel resonant circuit.

The parallel resonant circuit 4 is a circuit that can achieve parallel resonance at a desired frequency or, in other words, a circuit that has an infinite impedance at a desired frequency and can change the resonance frequency. As a specific example of the parallel resonant circuit 4, FIG. 2 shows a circuit comprising a variable capacitor 4*a* and an inductive reactance element 4*b* connected in parallel with each other. The parallel resonant circuit shown in FIG. 2 primarily serves to change the capacitance value of the variable capacitor 4*a* to change the reactance value, thereby increasing the input impedance of the parallel resonant circuit to infinity or a value close to infinity or changing the input impedance from infinity or a value close to infinity at a desired frequency. When the impedance is infinity or a value close to infinity, the parallel resonant circuit is equivalent to a switch in an open state. When the impedance is neither infinity nor a value close to infinity, the parallel resonant circuit is equivalent to a switch in an ON state or a state close to the ON state. The parallel resonant circuit 4 is not limited to the circuit comprising a plurality of circuit elements connected in parallel with each other as shown in FIG. 2, and any circuit that achieves parallel resonance at a desired frequency can be used as the parallel resonant circuit 4. For example, a circuit shown in FIG. 13G can be used as the parallel resonant circuit 4.

The parallel resonant circuits 4 are electrically connected to the line part 1 at one end thereof at different positions along the circumference of the line part 1. The parallel resonant circuits 4 are connected to a grounding conductor provided on the back surface of the dielectric substrate, for example, at the other end thereof. However, the parallel resonant circuit 4 can be formed by a transmission line, for example, and therefore, the end of the parallel resonant circuit 4 opposite to the end connected to the line part 1 does not always have to be grounded.

The positions on the line part 1 at which one ends of the parallel resonant circuits 4 are electrically connected can be appropriately determined so as to achieve a desired bandwidth. The parallel resonant circuits 4 can be connected to the positions at which the variable reactance blocks 2 are connected to the line part 1.

The bandwidth can be changed by changing the capacitance value of the variable capacitors 4*a* to vary the impedance of the parallel resonant circuits 4 disposed at different positions to values excluding infinity and minus infinity.

In the example shown in FIG. 1, the variable resonator is connected to a transmission line 5 connecting a port 1 and a port 2 as a branch circuit and is powered at a connection point 6. The combination of the variable resonator and the transmission line 5 is referred to as a variable filter.

Figure 3:
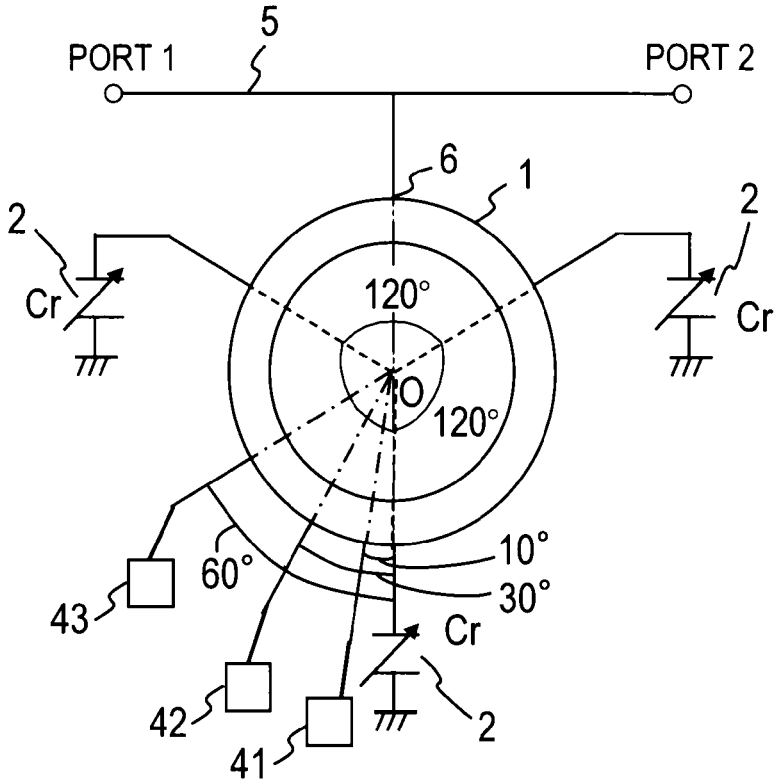
FIG. 3 is a diagram for illustrating the variable resonator.

FIG. 3 shows an exemplary circuit configuration for illustrating characteristics of the resonator. A variable capacitor Cr serves as the variable reactance block 2, an inductor serves as the inductive reactance element 4*b* of the parallel resonant circuit 4, and the inductor has an inductance of 1 nH. The annular line part 1 has a length equivalent to one wavelength at 5 GHz and has a characteristic impedance of 50Ω. Three parallel resonant circuits 4 are connected to the line part 1 at positions 10°, 30° and 60° away clockwise from the position 180° opposite to the connection point 6. The parallel resonant circuit 4 connected at the "10° away" position is referred to as a parallel resonant circuit 41, the parallel resonant circuit 4 connected at the "30° away" position is referred to as a parallel resonant circuit 42, and the parallel resonant circuit 4 connected at the "60° away" position is referred to as a parallel resonant circuit 43.

First, the resonance frequency is assumed to be 5 GHz, for example. To change the bandwidth, the variable capacitance Cr of the variable reactance blocks 2 is set at 0 pF. For any of the parallel resonant circuits 41, 42 and 43 that is equivalent to a switch in the open state, the capacitance value of the variable capacitor 4*a* is set so that the variable capacitor 4*a* and the inductive reactance element 4*b* achieve parallel resonance.

Figure 4A:
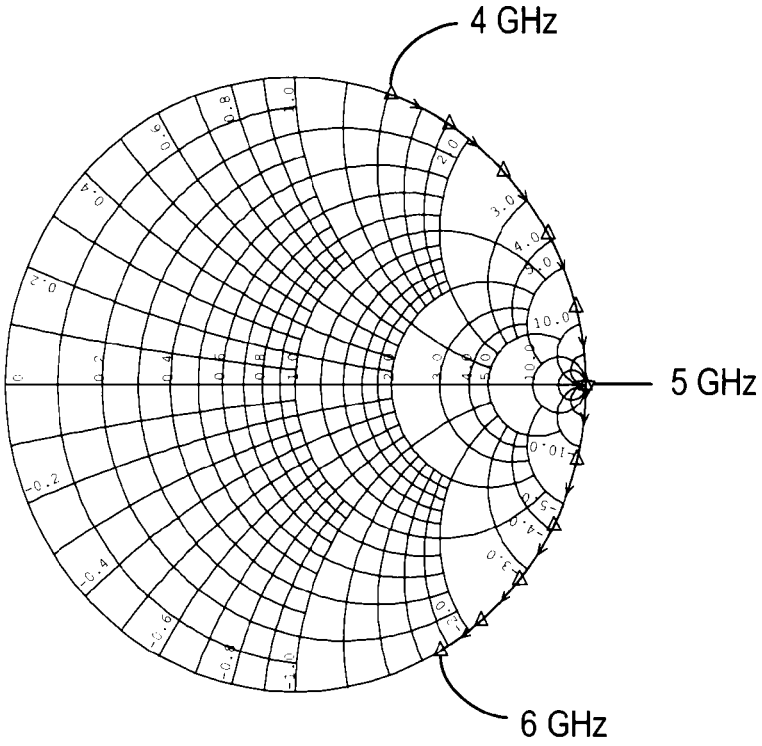
FIG. 4A is a Smith chart for illustrating the variable resonator shown in FIG. 3.
Figure 4B:
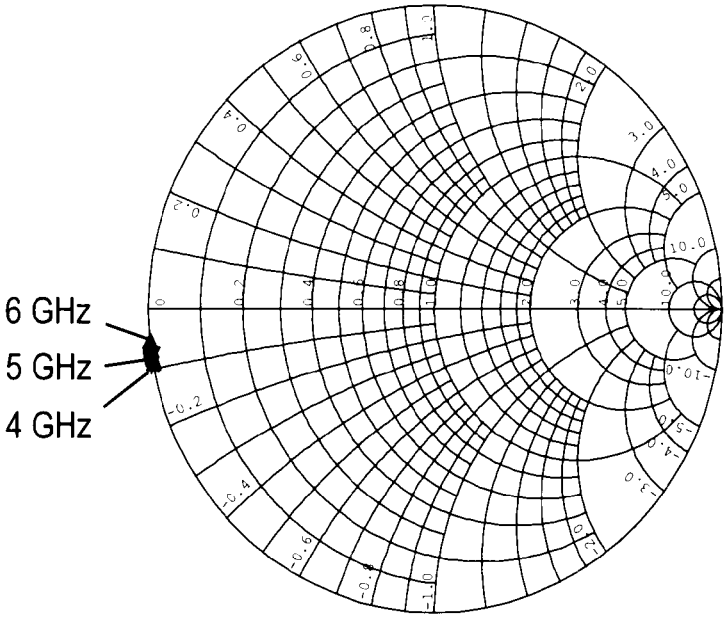
FIG. 4B is a Smith chart for illustrating the variable resonator shown in FIG. 3.

FIGS. 4A and 4B are Smith charts showing the impedance of the parallel resonant circuits 41, 42 and 43. In the case where the resonance frequency is 5 GHz, and the inductor has an inductance of 1 nH, if the capacitance value of the variable capacitor is about 1 pF, the impedance is approximately infinite, as shown in FIG. 4A. For the convenience of explanation, for any of the parallel resonant circuits 41, 42 and 43 that is equivalent to a switch in an open state, the capacitance value of the variable capacitor 4*a* is represented as Coff. In the case shown in FIG. 4A, the capacitance value Coff is suitably 1 pF. On the other hand, for any of the parallel resonant circuits 41, 42 and 43 that is equivalent to a switch in an ON state, the capacitance value of the variable capacitor 4*a* is denoted by Con. As can be seen from FIG. 4B, if the capacitance value Con is 10 pF, the parallel resonant circuits 41, 42 and 43 have an impedance close to 0 at 5 GHz and exhibit characteristics close to those of the switch in the ON state.

Figure 5:
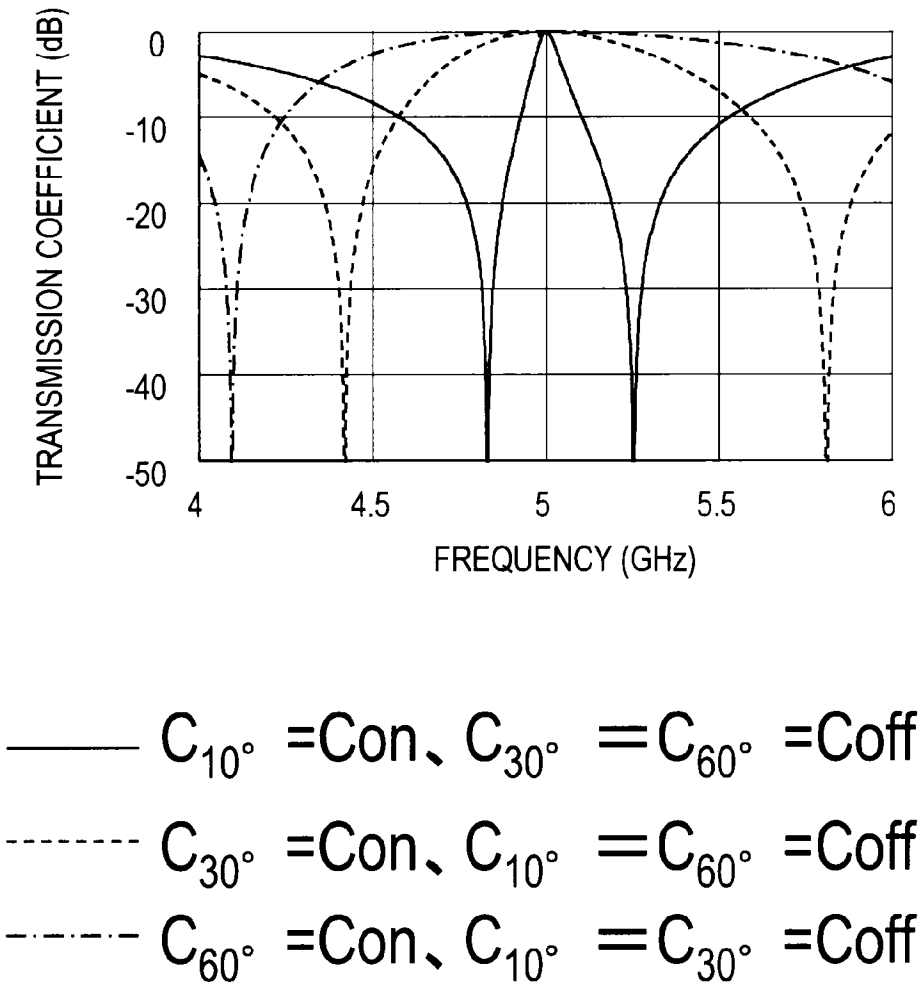
FIG. 5 is a graph showing frequency characteristics of the variable resonator shown in FIG. 3.

One of the parallel resonant circuits is selected as a circuit to operate as the switch in the ON state, and the capacitance value of the variable capacitor of the parallel resonant circuit is set at Con. The capacitance value of the variable capacitor of the remaining parallel resonant circuits is set at Coff, so that the parallel resonant circuits operate as the switch in the open state. As shown in FIG. 5, the bandwidth can be changed while keeping the resonance frequency constant by changing the parallel resonant circuit that operates as the switch in the ON state. In FIG. 5, the solid line indicates a transmission coefficient of a signal input to the port 1 transmitted from the port 1 to the port 2 in a case where the capacitance value $C_{10°}$ of the variable capacitor of the parallel resonant circuit 41 is set at Con, and the capacitance values $C_{30°}$ and $C_{60°}$ of the remaining parallel resonant circuits 42 and 43 are set at Coff ($C_{30°}$=$C_{60°}$=Coff). Similarly, the dashed line indicates the transmission coefficient in a case where the capacitance value $C_{30°}$ of the variable capacitor of the parallel resonant circuit 42 is set at Con, and the capacitance values $C_{10°}$ and $C_{60°}$ of the remaining parallel resonant circuits 41 and 43 are set at Coff ($C_{10°}$=$C_{60°}$=Coff), and the alternate short and long dash line indicates the transmission coefficient in a case where the capacitance value $C_{60°}$ of the variable capacitor of the parallel resonant circuit 43 is set at Con, and the capacitance values $C_{10°}$ and $C_{30°}$ of the remaining parallel resonant circuits 41 and 42 are set at Coff ($C_{10°}$=$C_{30°}$=Coff).

Figure 6A:
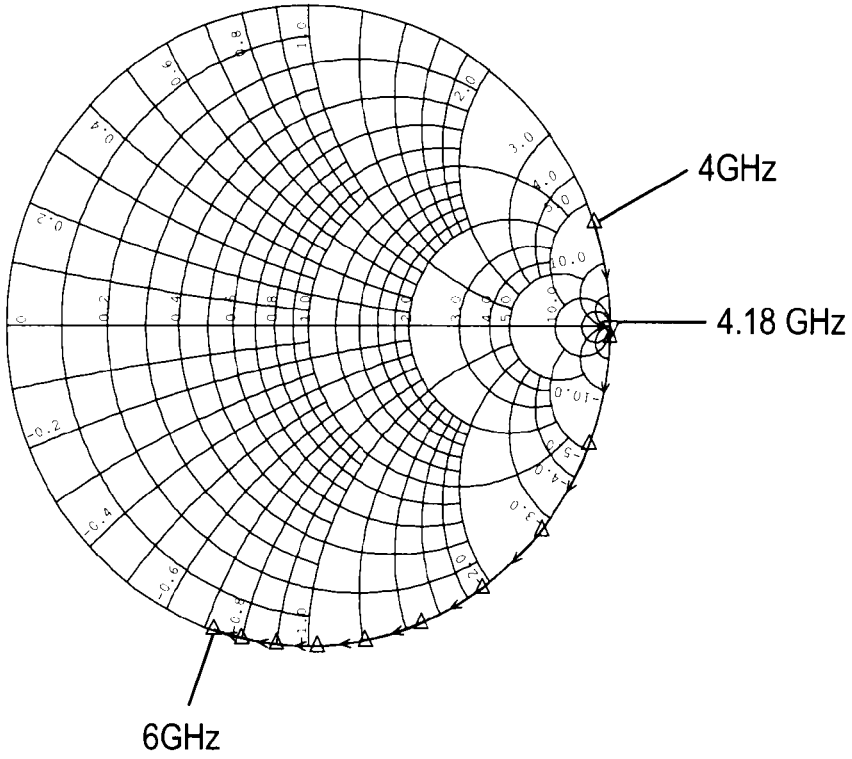
FIG. 6A is a Smith chart for illustrating the variable resonator shown in FIG. 3.
Figure 6B:
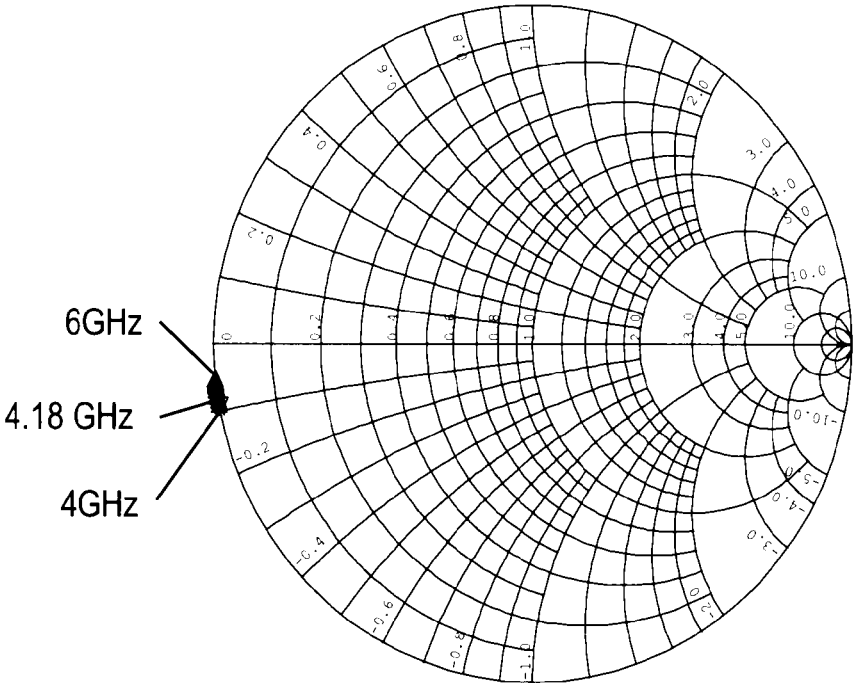
FIG. 6B is a Smith chart for illustrating the variable resonator shown in FIG. 3.

Next, a case where the resonance frequency is 4.2 GHz, the capacitance value Cr of the variable reactance blocks 2 is 0.5 pF, and the inductor has an inductance of 1 nH will be considered. In this case, when the capacitance value of the variable capacitor of the parallel resonant circuits 41, 42 and 43 is 1.43 pF, the impedance of the parallel resonant circuits 41, 42 and 43 is approximately infinite, as shown in FIG. 6A. When the capacitance value of the variable capacitor of the parallel resonant circuits 41, 42 and 43 is 10 pF, the impedance of the parallel resonant circuits 41, 42 and 43 is approximately 0, as shown in FIG. 6B. Thus, in this case, Coff=1.43 pF, and Con=10 pF.

Figure 7:
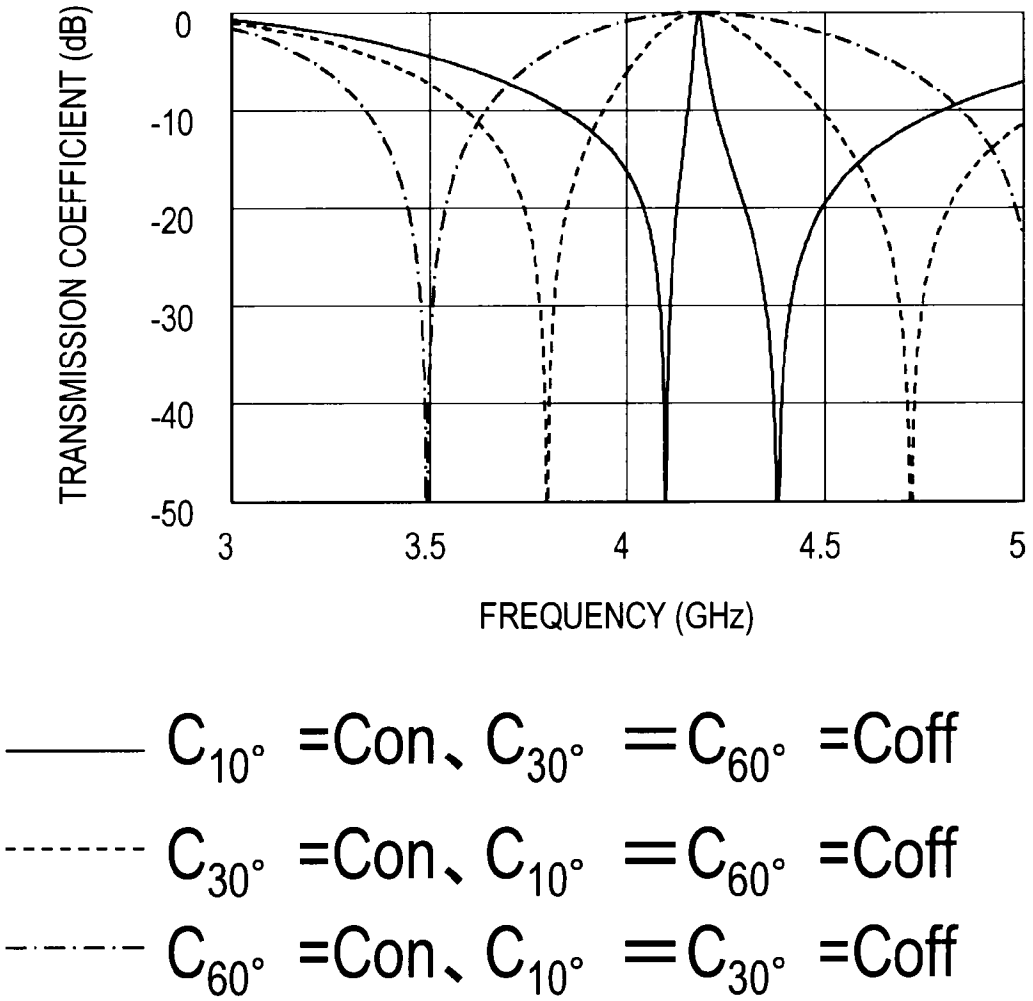
FIG. 7 is a graph showing frequency characteristics of the variable resonator shown in FIG. 3.

FIG. 7 shows a transmission coefficient in this case when the capacitance value of the parallel resonant circuits 41, 42 and 43 is changed. In FIG. 7, the solid line indicates a transmission coefficient of a signal input to the port 1 and transmitted from the port 1 to the port 2 in a case where the capacitance value $C_{10°}$ of the variable capacitor of the parallel resonant circuit 41 is set at Con, and the capacitance values $C_{30°}$ and $C_{60°}$ of the remaining parallel resonant circuits 42 and 43 are set at Coff ($C_{30°}$=$C_{60°}$=Coff). Similarly, the dashed line indicates the transmission coefficient in a case where the capacitance value $C_{30°}$ of the variable capacitor of the parallel resonant circuit 42 is set at Con, and the capacitance values $C_{10°}$ and $C_{60°}$ of the remaining parallel resonant circuits 41 and 43 are set at Coff ($C_{10°}$=$C_{60°}$=Coff), and the alternate short and long dash line indicates the transmission coefficient in a case where the capacitance value $C_{60°}$ of the variable capacitor of the parallel resonant circuit 43 is set at Con, and the capacitance values $C_{10°}$ and $C_{30°}$ of the remaining parallel resonant circuits 41 and 42 are set at Coff ($C_{10°}$=$C_{30°}$=Coff).

As can be seen from the above description, the bandwidth can be changed by changing the capacitance value of the variable capacitor of the parallel resonant circuits. The principle is the same as that described in Japanese Patent Application Laid-Open No. 2008-206078 and therefore will not be further described herein.

The attenuation in a lower-frequency-side proximity to the resonance frequency can be increased by changing the value Con while keeping the values Cr and Coff fixed or, in other words, by changing the capacitance value of the variable capacitor of the parallel resonant circuit that operate as a switch in an ON state. More specifically, the frequency of an attenuation pole on the lower frequency side of the resonance frequency and the frequency of an attenuation pole on the higher frequency side of the resonance frequency can be raised by decreasing the capacitance value of the variable capacitor of any one of the parallel resonant circuits that operates as a switch in an ON state.

Figure 8:
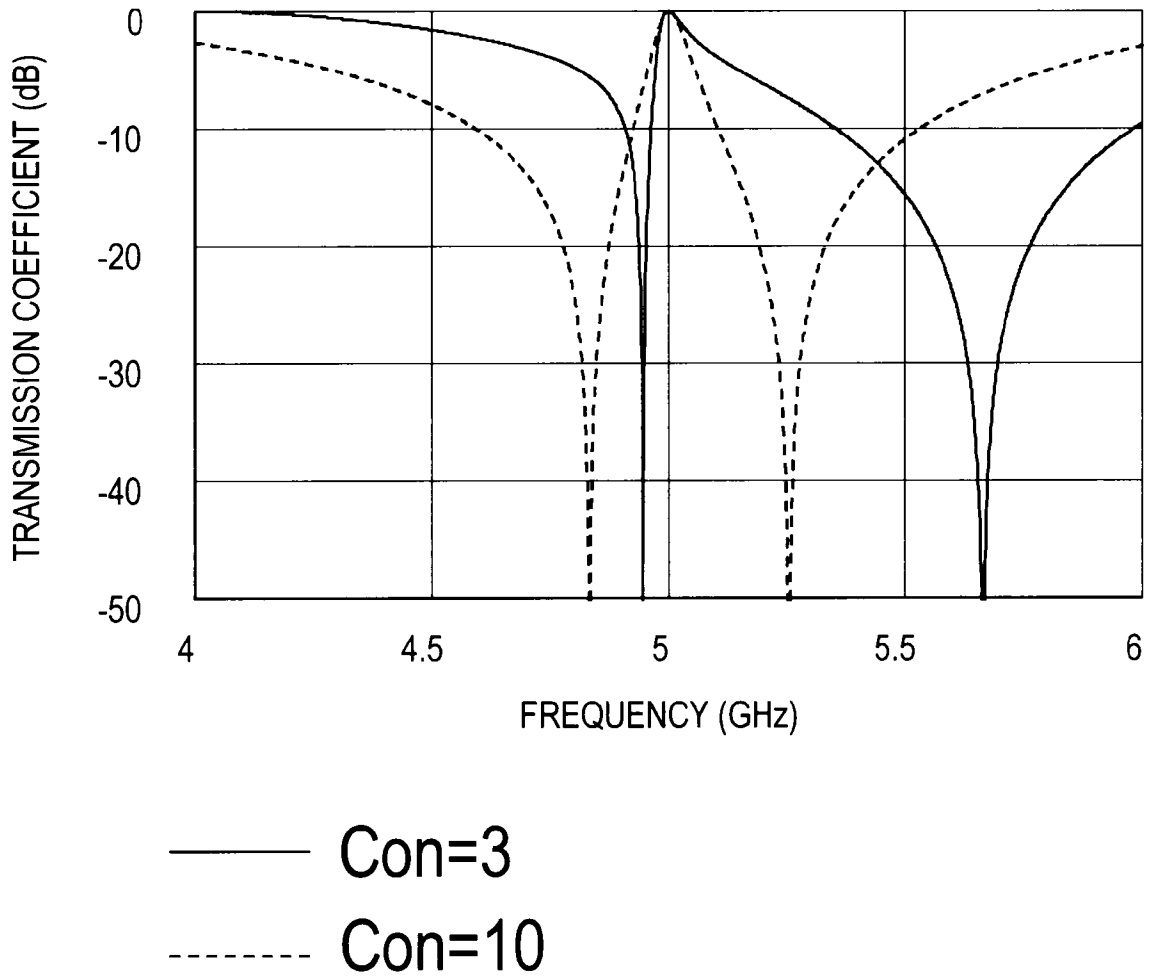
FIG. 8 is a graph showing frequency characteristics of the variable resonator in a case where a capacitance Con varies.

For example, FIG. 8 shows transmission coefficients of the variable resonator shown in FIG. 3 in cases where the capacitance value Con is 10 pF and where the capacitance value Con is 3 pF, on the assumption that the capacitance value Cr is 0 pF, the resonant frequency is 5 GHz, and $C_{30°}$=$C_{60°}$=Coff. As shown in FIG. 8, when the capacitance value Con is 10 pF, the variable resonator exhibits frequency characteristics substantially symmetrical with respect to the resonance frequency as in the case shown by the solid line in FIG. 5. However, when the capacitance value Con is 3 pF, the frequencies of the attenuation poles are raised, and the attenuation in the lower-frequency-side proximity to the resonance frequency increases compared with the case where the capacitance value Con is 10 pF. In this way, the frequency characteristics can be biased so that the attenuation increases in the lower-frequency-side proximity, for example, by appropriately setting the capacitance value Con.

Figure 9:
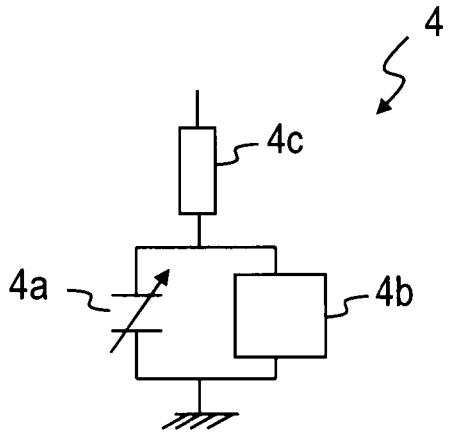
FIG. 9 is a diagram showing a modification of the parallel resonant circuit.

The parallel resonant circuit 4 may be a parallel resonant circuit including a transmission line as shown in FIG. 9. The parallel resonant circuit is a series connection of the resonant circuit shown in FIG. 2 and a transmission line having an electrical length of 25° at 5 GHz. However, the electrical length of the transmission line can be arbitrarily set so as to achieve desired characteristics and is not limited to 25° described above. Using the transmission line facilitates configuration of a parallel resonant circuit having desired frequency characteristics. Even when the parallel resonant circuit includes the transmission line, the attenuation can be changed in the lower-frequency-side proximity and a higher-frequency-side proximity to the resonance frequency by changing the frequencies of the attenuation poles by changing the capacitance value Con. This property is advantageous in application of the variable resonator to a transceiver.

Figure 10:
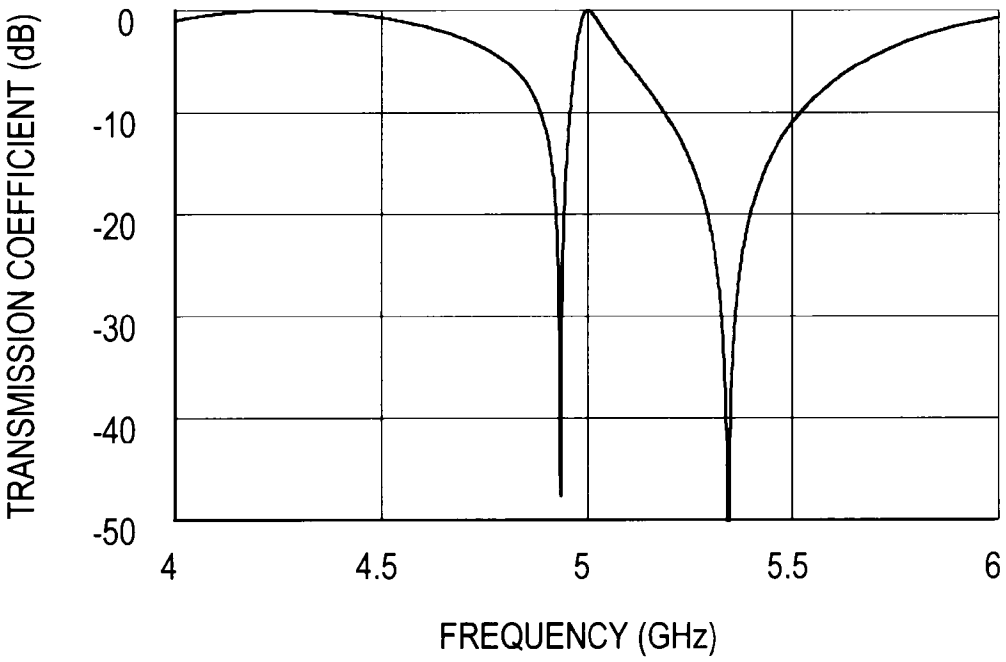
FIG. 10 is a graph showing frequency characteristics of the variable resonator using the parallel resonant circuit shown in FIG. 9.
Figure 11:
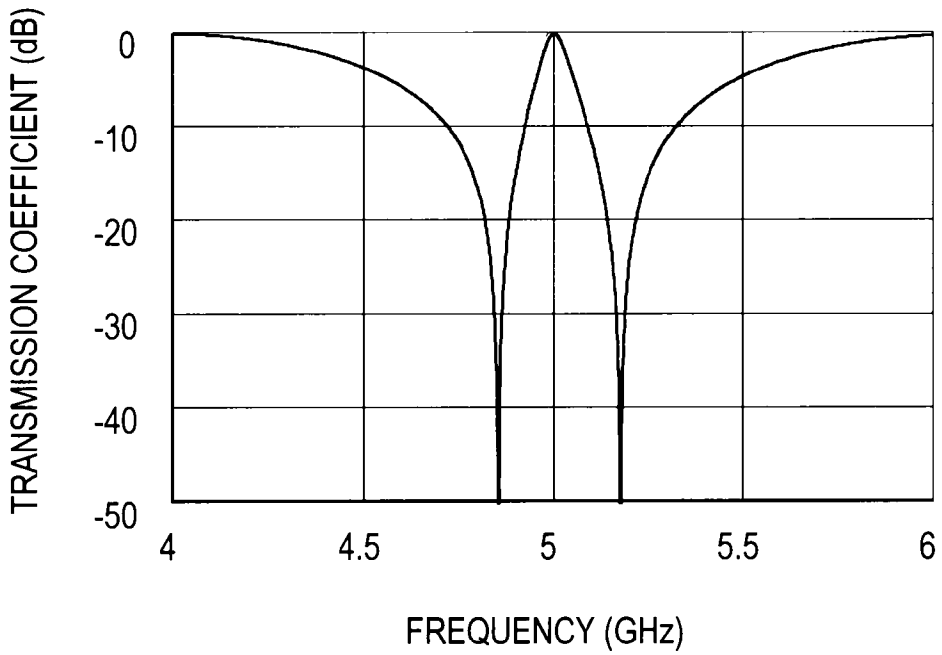
FIG. 11 is a graph showing frequency characteristics of the variable resonator using the parallel resonant circuit shown in FIG. 9.
Figure 12:
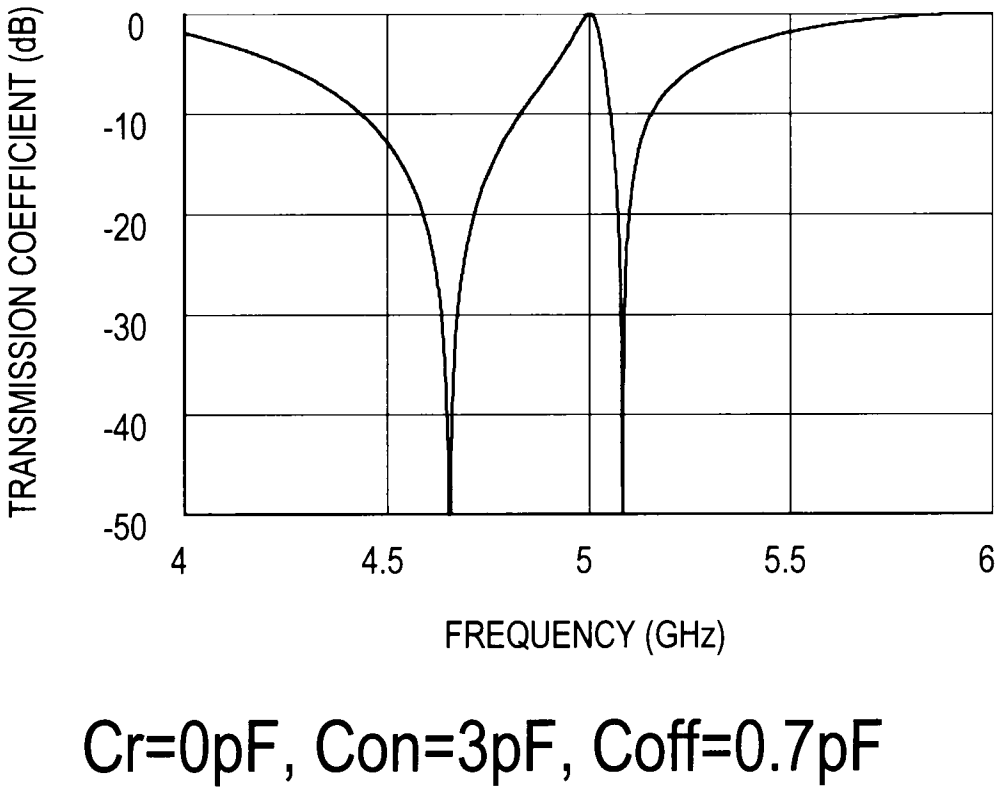
FIG. 12 is a graph showing frequency characteristics of the variable resonator using the parallel resonant circuit shown in FIG. 9.

FIG. 10 shows a transmission coefficient of the variable resonator shown in FIG. 3 in a case where the capacitance value Cr is 0 pF, the resonant frequency is 5 GHz, $C_{30°}=C_{60°}=Coff=0.7$ pF, and $C_{10°}=Con=1.8$ pF. FIG. 11 shows a transmission coefficient of the variable resonator shown in FIG. 3 in a case where the capacitance value Cr is 0 pF, the resonant frequency is 5 GHz, $C_{30°}=C_{60°}=Coff=0.7$ pF, and $C_{10°}=Con=2.2$ pF. FIG. 12 shows a transmission coefficient of the variable resonator shown in FIG. 3 in a case where the capacitance value Cr is 0 pF, the resonant frequency is 5 GHz, $C_{30°}=C_{60°}=Coff=0.7$ pF, and $C_{10°}=Con=3$ pF.

As shown in FIGS. 10 to 12, even for the parallel resonant circuit including a transmission line, by decreasing the capacitance value of the variable capacitor of any one of the parallel resonant circuits that operates as a switch in an ON state, the frequency of an attenuation pole on the lower frequency side of the resonance frequency and the frequency of an attenuation pole on the higher frequency side of the resonance frequency can be raised, and the attenuation can be changed in the lower-frequency-side proximity and the higher-frequency-side proximity to the resonance frequency.

Figure 13C:
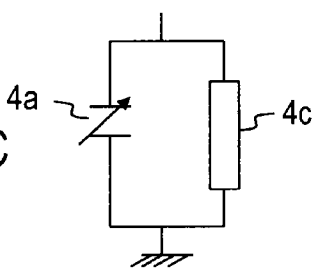
FIG. 13C is a diagram showing a modification of the parallel resonant circuit.
Figure 13B:
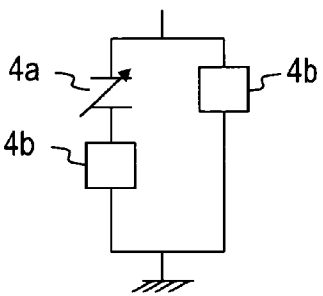
FIG. 13B is a diagram showing a modification of the parallel resonant circuit.
Figure 13A:
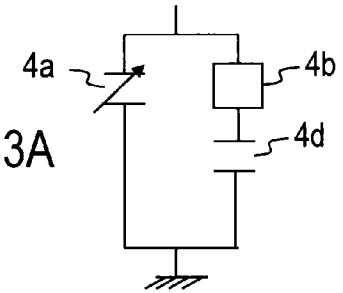
FIG. 13A is a diagram showing a modification of the parallel resonant circuit.
Figure 13E:
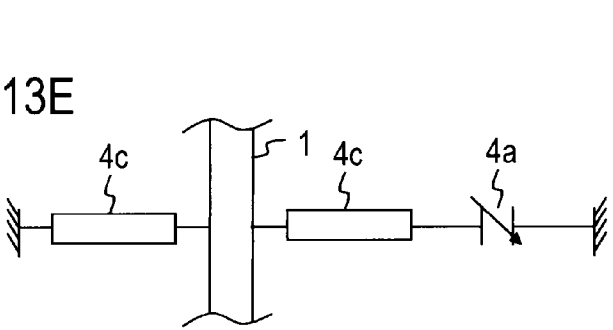
FIG. 13E is a diagram showing a modification of the parallel resonant circuit.
Figure 13D:
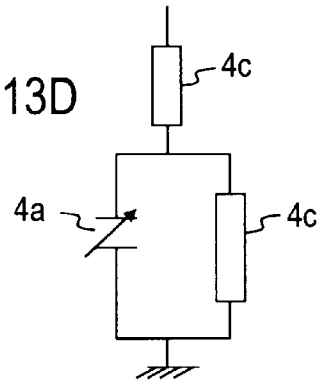
FIG. 13D is a diagram showing a modification of the parallel resonant circuit.
Figure 13G:
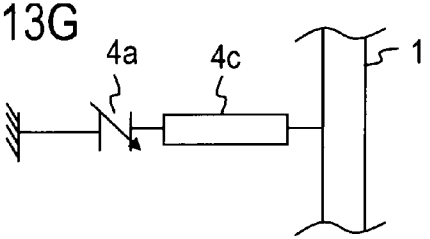
FIG. 13G is a diagram showing a modification of the parallel resonant circuit.
Figure 13F:
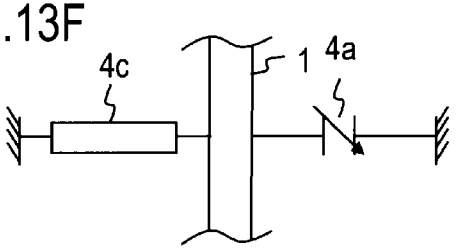
FIG. 13F is a diagram showing a modification of the parallel resonant circuit.

The parallel resonant circuit 4 may be circuits shown in FIGS. 13A to 13G. FIG. 13A shows a circuit comprising a series connection of an inductive reactance element 4*b* and a fixed capacitor 4*d* and a variable capacitor 4*a* connected in parallel with each other. FIG. 13B shows a circuit comprising a series connection of a variable capacitor 4*a* and an inductive reactance element 4*b* and another inductive reactance element 4*b* connected in parallel with each other. FIG. 13C shows a circuit comprising a variable capacitor 4*a* and a transmission line 4*c* connected in parallel with each other. FIG. 13D shows a circuit comprising a parallel connection of a variable capacitor 4*a* and a transmission line 4*c* and another transmission line 4*c* connected in series with each other. FIG. 13E shows a circuit comprising a transmission line 4*c* connected to one side of the line part 1 and a series connection of another transmission line 4*c* and a variable capacitor 4*a* connected to the other side of the line part 1. In this way, the circuit elements of the parallel resonant circuit 4 may be distributed on the opposite sides of the line part 1 or, in other words, on the inner side and the outer side of the line part 1. In this case, the design flexibility of the variable resonator and the variable filter increases. In the parallel resonant circuit shown in FIG. 13E, the transmission line 4*c* connected to the variable capacitor 4*a* may have a length of 0. That is, as shown in FIG. 13F, the transmission line 4*c* may be connected to one side of the line part 1, and the variable capacitor 4*a* may be directly connected to the other side of the line part 1 without the transmission line 4*c*. FIG. 13G shows a circuit comprising a transmission line 4*c* and a variable capacitor 4*a* connected in series with each other. Even a circuit comprising two elements connected in series with each other, such as the circuit shown in FIG. 13G, can achieve parallel resonance at a desired frequency and thus can be used as a parallel resonant circuit.

The parallel resonant circuit 4 is not limited to those illustrated in FIGS. 2 and 13A to 13G but may be any circuit that can be turned off by maximizing the impedance by parallel resonance at a desired frequency and can be turned on by setting a variable capacitor so as to prevent parallel resonance at a desired frequency.

Figure 14:
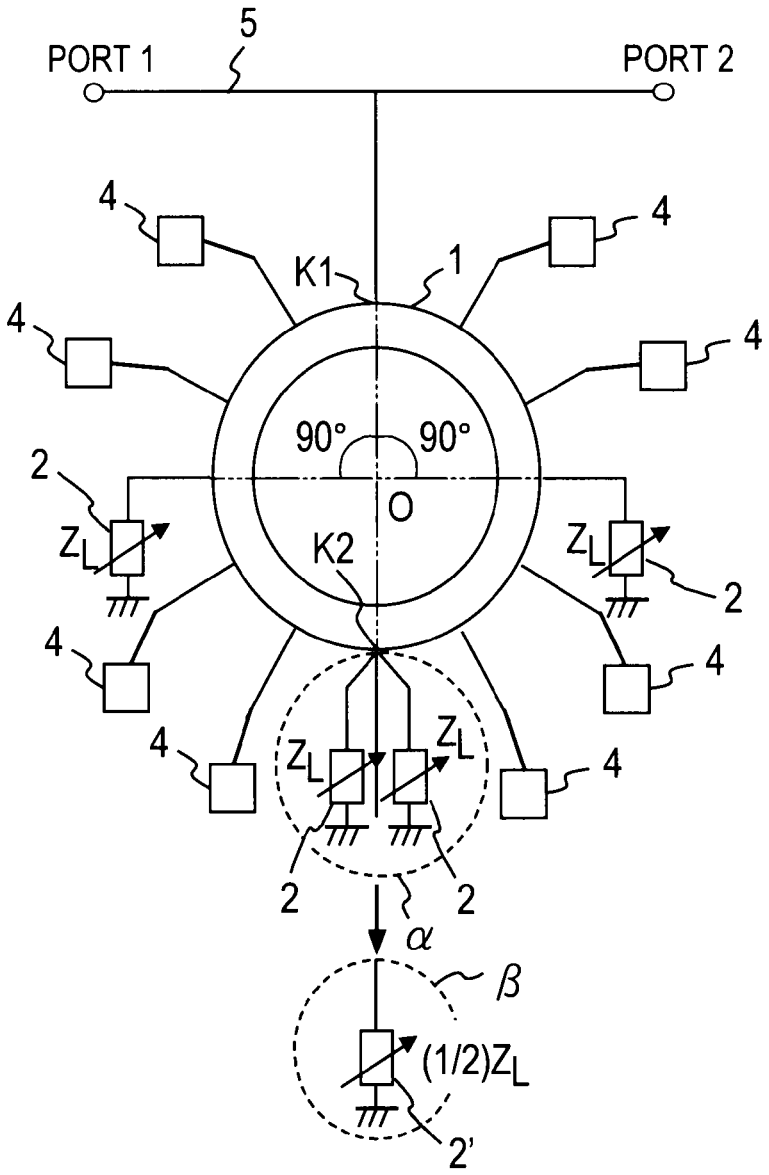
FIG. 14 is a diagram showing a modification of the variable resonator.

The variable reactance blocks 2 may be disposed as illustrated in FIG. 14. In the variable resonator shown in FIG. 14, M variable reactance blocks 2 are electrically connected to the line part 1 as a branch circuit (M represents an even number equal to or greater than 4). More specifically, M/2−1 variable reactance blocks 2 are connected to the line part 1 along the circumference thereof within a range clockwise from an arbitrarily set position K1 to a position K2 spaced away from the position K1 by a half of the electrical length of the line part 1, the positions on the line part 1 at which the variable reactance blocks 2 are connected being at equal electrical distances at a resonance frequency at which one wavelength or an integral multiple thereof equals to the perimeter of the line part 1. The equal electrical distances referred to here mean the equal electrical distances on the condition that no variable reactance block 2 is disposed at the positions K1 and K2. Similarly, M/2−1 variable reactance blocks 2 of the remaining variable reactance blocks 2 are connected to the line part 1 along the circumference thereof within a range counterclockwise from the position K1 to the position K2 at equal electrical distances. The equal electrical distances referred to here also mean the equal electrical distances on the condition that no variable reactance block 2 is disposed at the positions K1 and K2. The remaining two variable reactance blocks 2 are connected to the position K2. The terms "clockwise" and "counterclockwise" used above means directions along the circumference viewed from above the sheet of the drawing (the same holds true for the following description). As with the variable resonator shown in FIG. 1, in a practical design, the resonance frequency at which one wavelength or an integral multiple thereof equals to the perimeter of the line part 1 can be the resonance frequency of the variable resonator having no variable reactance block 2 connected thereto, for example.

If the dielectric substrate has a uniform relative dielectric constant, the equal electrical distances are equivalent to equal physical distances. In this case, M/2 variable reactance blocks 2 are connected to the line part 1 along the circumference thereof within a range clockwise from an arbitrarily set position (equivalent to the position K1 described above) to a position spaced away from that position by a half of the perimeter L of the line part 1 (equivalent to the position K2 described above), the positions on the line part 1 at which the variable reactance blocks 2 are connected being spaced apart from each other by a distance of (L/M)*m (m represents an integer that satisfies a condition that $1 \le m \le M/2$). Similarly, the remaining M/2 variable reactance blocks 2 are connected to the line part 1 along the circumference thereof within a range counterclockwise from the position K1 to the position K2 spaced away from the position K1 by a half of the perimeter L of the line part 1, the positions on the line part 1 at which the variable reactance blocks 2 are connected being spaced apart from each other by a distance of (L/M)*m (m represents an integer that satisfies a condition that $1 \le m \le M/2$). That is, no variable reactance block 2 is connected to the line part 1 at the position K1, and two variable reactance blocks 2 are connected to the line part 1 at a position K2 clockwise or counterclockwise spaced apart from the position K1 by a distance of (L/M)*M/2.

In particular, if the line part 1 has a circular shape, the M variable reactance blocks 2 are connected to the line part 1 at angular positions, about the center O of the line part 1, clockwise spaced apart from the arbitrarily set position K1 by an angle of 360° divided by M and multiplied by m and angular positions counterclockwise spaced apart from the position K1 by an angle of 360° divided by M and multiplied by m. The position clockwise spaced apart from the position K1 along the circumference of the line part 1 by an angle of 360° divided by M and multiplied by M/2 agrees with the position counterclockwise spaced apart from the position K1 along the circumference of the line part 1 by an angle of 360° divided by M and multiplied by M/2, and two variable reactance blocks 2 are connected to the line part 1 at the point (a circle α shown by a dashed line in FIG. 14 shows a case where M=4). In the example shown in FIG. 14, the end of each variable reactance block 2 opposite to the end connected to the line part 1 is grounded by electrical connection to a grounding conductor, for example.

The two variable reactance blocks 2 electrically connected to the line part 1 at the position K2, that is, the two variable reactance blocks 2 shown in the circle a shown by the dashed line in FIG. 14 may be replaced with a single variable reactance block 2' (as shown in a circle 13 shown by a dashed line in FIG. 14). In this case, note that the reactance value of the single variable reactance block 2' is set to be a half of the reactance value of the variable reactance block 2 electrically connected at the other positions, because the reactance value of the single variable reactance block 2' is equivalent to the synthetic reactance of the two variable reactance blocks 2. In this case, of course, the total number of variable reactance blocks 2 is M−1.

Figure 15:
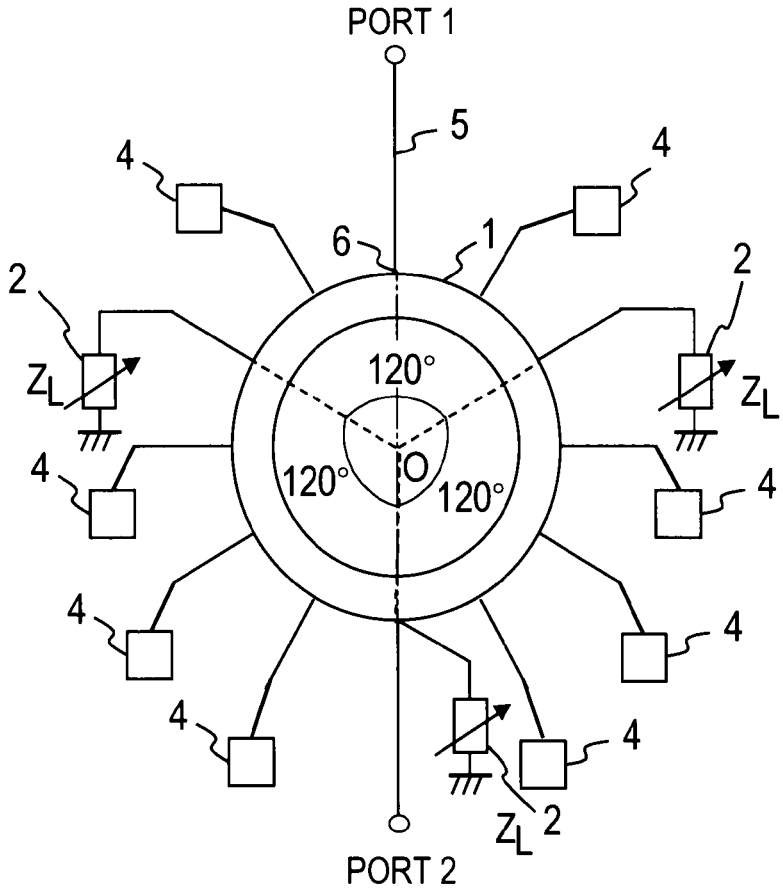
FIG. 15 is a diagram showing a modification of the variable resonator.
Figure 16:
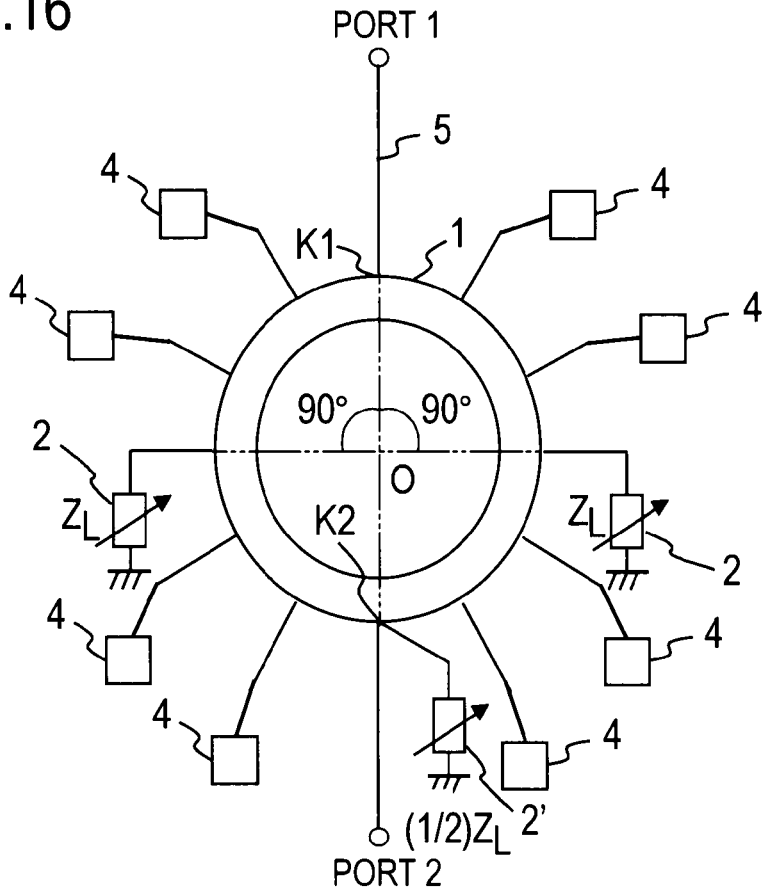
FIG. 16 is a diagram showing a modification of the variable resonator.

Alternatively, as shown in FIGS. 15 and 16, a variable filter may be formed by connecting the variable resonator in series with the transmission line 5 connecting the port 1 and the port 2.

In the above and similar variable resonators, the variable reactance blocks 2 are electrically connected to the line part 1 having an annular shape. However, as shown in FIG. 17, the annular line part 1 may be cut into a plurality of line segments (such as line segments 1*a*, 1*b* and 1*c* shown in FIG. 17), and the variable reactance blocks 2 may be inserted in the gaps between the line segments and electrically connected to the line segments in series with each other.

The perimeter of the line part 1 yet to be cut is the same as the sum of the lengths of the line segments. In the example shown in FIG. 17, the line segments 1*a*, 1*b* and 1*c* have the same length, and the sum of the lengths equals to the perimeter L of the annular line part 1. Although not shown in FIG. 17, the positions at which the parallel resonant circuits 4 are connected to the line part 1 are determined so as to achieve a desired bandwidth as described above, and the positions are not changed even if the line part is cut into a plurality of line segments. Therefore, some of the line segments may have no parallel resonant circuit connected thereto.

Figure 17:
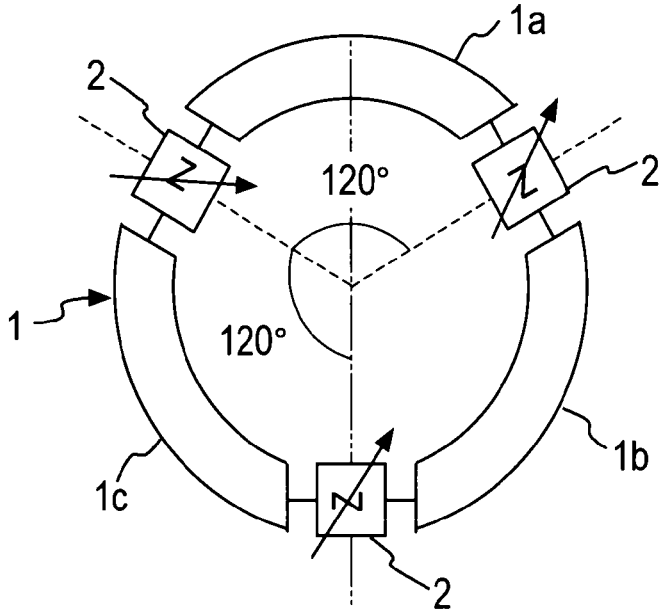
FIG. 17 is a diagram showing a modification of the variable resonator.
Figure 18:
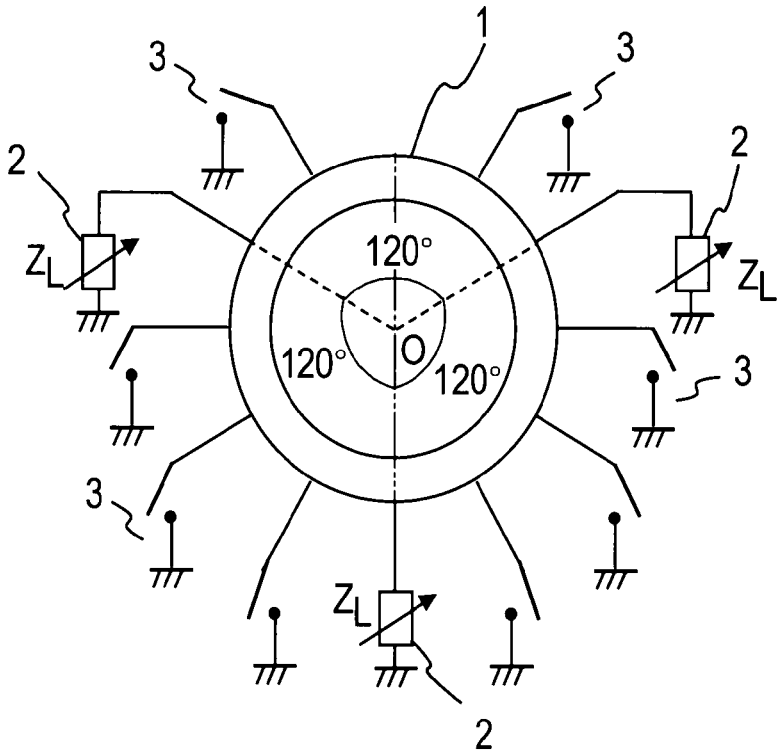
FIG.18 PRIOR ART
FIG. 18 is a diagram showing a conventional variable resonator.

In other words, the variable resonator shown in FIG. 17 is an annular variable resonator comprising a plurality of line segments and a plurality of variable reactance blocks 2. Although the annular line part 1 is cut into line segments 1*a*, 1*b* and 1*c* at positions at which the variable reactance blocks 2 are connected to the line part 1 in this example, in general, the line part 1 can be cut into N line segments (N represents an integer equal to or greater than 3 (N≥3)). An annular variable resonator can be formed by disposing the line segments in an angular configuration and electrically serially connecting one variable reactance block 2 between every adjacent two of the line segments. The length of each line segment can be equal to an electrical length at a resonance frequency at which one wavelength or an integral multiple thereof equals to the sum of the lengths of the line segments. If the dielectric substrate has a uniform relative dielectric constant, the variable resonator can also be formed based on the physical length instead of the electrical length.

The parallel resonant circuit 4 can change the reactance component of the input impedance of the parallel resonant circuit by changing the capacitance of the variable capacitor in the circuit and therefore can be used also as the variable reactance block 2. In other words, the same circuit can be used as the parallel resonant circuit 4 and the variable reactance block 2. This allows inexpensive mass production of the variable resonator and the variable filter, and the variable resonator and the variable filter are more suitable for the semiconductor manufacturing technology that involves inexpensive mass production of identical parts.

The present invention is not limited to the embodiment described above but can be appropriately modified without departing from the spirit of the present invention. For example, although a microstrip line structure is shown as an example in the embodiment described above, the present invention is not limited to such a line structure but can use other line structures, such as a coplanar waveguide structure.

What is claimed is:

1. A variable resonator, comprising:

a line part that comprises one or more lines and has an annular shape;

at least two parallel resonant circuits configured to permit a change of a characteristic; and at least three variable reactance blocks configured to permit a change of a reactance value, wherein said at least two parallel resonant circuits are electrically connected to said line part at one end thereof at different positions on the line part, only one parallel resonant circuit of said at least two parallel resonant circuits is selected as a circuit to operate as a switch in an ON state, each remaining parallel resonant circuit of said at least two parallel resonant circuits, which is not selected as the circuit to operate as the switch in the ON state, is selected as a circuit to operate as a switch in an open state, and said at least three variable reactance blocks are electrically connected to said line part at predetermined intervals based on an electrical length at a resonance frequency of the variable resonator.

2. The variable resonator according to claim 1, wherein said at least two parallel resonant circuits are configured to permit a change of a reactance value, and said at least three variable reactance blocks are the same as said at least two parallel resonant circuits.

3. The variable resonator according to claim 1 or 2, wherein said one or more lines are formed by one annular line, and said at least three variable reactance blocks are electrically connected to the annular line as a branch circuit at said predetermined intervals based on said electrical length at said resonance frequency at which one wavelength or an integral multiple thereof equals to a perimeter of said annular line.

4. The variable resonator according to claim 3, wherein said reactance values of said at least three variable reactance blocks are equal and said at least three variable reactance blocks are connected to said annular line at equal electrical distances.

5. The variable resonator according to claim 3, wherein a total number of said at least three variable reactance blocks is M, where M represents an even number equal to or greater than 4, said reactance values of said at least three variable reactance blocks are equal, a first set of M/2−1 variable reactance blocks of said at least three variable reactance blocks are connected to said annular line at equal electrical distances within a range clockwise from an arbitrarily set position K1 to a position K2 spaced apart from the position K1 by a half of an electrical length of said annular line, where any one of said first set of M/2−1 variable reactance blocks is not connected to the position K1 and the position K2, a second set of M/2−1 variable reactance blocks of said at least three variable reactance blocks are connected to said annular line at equal electrical distances within a range counterclockwise from said position K1 to said position K2, where any one of said second set of M/2−1 variable reactance blocks is not connected to the position K1 and the position K2, and two of said at least three variable reactance blocks are connected to said annular line at said position K2.

6. The variable resonator according to claim 3, wherein a total number of said at least three variable reactance blocks is M−1, where M represents an even number equal to or greater than 4, M−2 variable reactance blocks of said at least three variable reactance blocks have said reactance values equal, the M−2 variable reactance blocks being referred to as a first variable reactance blocks hereinafter, a remaining one of said at least three variable reactance blocks has said reactance value set to half of the reactance value of said first variable reactance blocks, the remaining one variable reactance block being referred to as a second variable reactance block hereinafter, a first set of M/2−1 variable reactance blocks of said first variable reactance blocks are connected to said annular line at equal electrical distances within a range clockwise from an arbitrarily set position K1 to a position K2 spaced apart from the position K1 by a half of an electrical length of said annular line, where any one of said first set of M/2−1 variable reactance blocks is not connected to the position K1 and the position K2, a second set of M/2−1 variable reactance blocks of said variable reactance blocks are connected to said annular line at equal electrical distances within a range counterclockwise from said position K1 to said position K2, where any one of said second set of M/2−1 variable reactance blocks is not connected to the position K1 and the position K2, and said second variable reactance block is connected to said annular line at said position K2.

7. The variable resonator according to claim 1 or 2, wherein said one or more lines are formed by at least three lines, each of said at least two parallel resonant circuits is electrically connected to any one of said at least three lines at one end thereof at a different position, each of said at least three lines has a predetermined electrical length at a resonance frequency at which one wavelength or an integral multiple thereof equals to a sum of the lengths of said at least three lines, and at least one of said at least three variable reactance blocks is electrically serially connected between every adjacent two of said at least three lines.

8. The variable resonator according to claim 7, wherein a total number of said at least three lines is N, and a total number of said at least three variable reactance blocks is N, where N represents an integer equal to or greater than 3, said reactance values of the at least three variable reactance blocks are equal, said at least three lines have an equal electrical length, and said at least one of said at least three variable reactance blocks includes one variable reactance block connected between said every adjacent two of said at least three lines.

9. A variable filter, comprising:

a variable resonator according to claim 1; and a transmission line, wherein said variable resonator and said transmission line are electrically connected to each other.

* * * * *